United States Patent [19]

Grover et al.

[11] Patent Number: 4,901,405

[45] Date of Patent: Feb. 20, 1990

[54] SELF-ALIGNING MAGNETIC NECKLACE CLASP

[76] Inventors: Alfred H. Grover; Verna A. Grover, both of 5436 Clark Rd. #27 A, Paradise, Calif. 95969

[21] Appl. No.: 236,172

[22] Filed: Aug. 25, 1988

[51] Int. Cl.[4] ..... A44B 21/00

[52] U.S. Cl. ..... 24/303; 248/206.5

[58] Field of Search ..... 24/303; 292/251.5; 248/206.5; 335/285, 286, 294, 302

[56] References Cited

U.S. PATENT DOCUMENTS

| | | | |
|---|---|---|---|
| 1,105,384 | 7/1914 | Topper | 24/303 |
| 2,615,227 | 10/1952 | Hornik | 24/ |
| 2,623,256 | 12/1952 | Feibelman | 24/ |
| 2,637,887 | 5/1953 | Goodman et al. | 24/ |
| 2,648,884 | 8/1953 | Loofboro | 24/ |
| 2,812,203 | 11/1957 | Scholten | 24/303 X |
| 2,975,497 | 3/1961 | Budreck | 24/ |
| 3,129,477 | 4/1964 | Mizuno | 24/ |
| 3,277,681 | 10/1966 | Bey | 70/ |
| 4,231,137 | 11/1980 | Fujimoto | 24/ |
| 4,455,719 | 6/1984 | Morita | 24/303 |
| 4,622,726 | 11/1986 | Nakamura | 24/ |
| 4,779,314 | 10/1988 | Aoki | 24/303 |

FOREIGN PATENT DOCUMENTS

| | | | |
|---|---|---|---|
| 2855708 | 7/1979 | Fed. Rep. of Germany | 24/303 |

*Primary Examiner*—Laurie K. Cranmer

[57] ABSTRACT

The device provides a cylindrical insert fitting easily through a retainer ring into a tubular chamber and held there by a magnetic structure. One end of a necklace is attached to a jewelry ring on the outside end of the insert and the other end is attached to a jewelry ring on the outside end of the tubular chamber. materials in the chamber wall allow special magnetic structure in the tubular chamber to pull the insert aligned near the tubular chamber opening into the chamber and secures the cylinder end against the magnetic structure. The clasp holds together well yet is easily unfastened. Special fittings for locking the clasp parts together are not required.

3 Claims, 1 Drawing Sheet

SELF-ALIGNING MAGNETIC NECKLACE CLASP

BACKGROUND OF THE INVENTION

1. Field of the Invention

This invention relates to jewelry couplers and fasteners in general, and more specifically to a two piece separable magnetic clasp for necklaces and bracelets.

2. Description of the Prior Art

Many types of jewelry fasteners have been in use over the years including metal and plastic clips, hooks, locks and threaded type connectors. One major problem associated with these devices is the relative difficulty in connecting the two separate ends of the fasteners, especially if the user has limited mobility of her hands. The problem is also compounded when connection is made where the fastener cannot be seen, such as behind the neck. Another disadvantage of many of the previously mentioned fasteners is poor durability, being generally manufactured of very thin, easily broken sections.

A search was conducted to uncover magnetic fasteners for jewelry, which were located in the following classes and subclasses: 24/303.

The follow patents were believed to be most relevant to my invention:

1. The Hornik patent, dated Oct. 28, 1952, U.S. Pat. No. 2,615,227, discloses a magnetic clasp coupling for jewelry with interfitting locking features.

2. On Dec. 30, 1952, Feibelman was issued U.S. Pat. No. 2,623,256, for "Connector For Bracelets and the Like" which shows a magnetic type connector which has a mechanical strain resistant interlock.

3. Budreck was issued U.S. Pat. No. 2,975,497, on Mar. 21, 1961, for a separable two-part magnetic connector using fairly large magnets.

4. Goodman et al, was granted U.S. Pat. No. 2,637,887, on May 12, 1953, for "Magnetic Jewelry Clasp" which features a magnet in a round or square clasp, quite large for jewelry applications, with a round or flat plate as the second connector.

5. On Aug. 18, 1953, Loofboro was issued U.S. Pat No. 2,648,884, for a magnetic clasp useful for necklace connectors, bracelet connectors, and belt fasteners. The device uses two interfitting sections with a somewhat U-shaped magnet. When the sections are together they form a capsule-like clasp housing.

6. U.S. Pat. No. 3,129,477 was granted to Mizuno on Apr. 21, 1964, for another magnetic clasp. A rounded magnet container sets flush against a similar rounded attachment. Joining parts hold the magnetized containers positioned.

7. On Oct. 11, 1966, Bey was granted U.S. Pat. No. 3,277,681 for "Dual Key Ring Including Magnetic Fastener." The device is a two-piece key ring holder. A small cylinder is retained in a circumventing closure by a magnetic field.

8. Fujimoto was issued U.S. Pat. No. 4,231,137 on Nov. 4, 1980, for "Clasp For Personal Ornaments Or Furnishings." This clasp appears to have combined the capsule feature of Loofboro's invention with the attachment loops of the Bey device. Fujimoto has simply moved the attachment rings from the ends to the edges of the two clasping halves. Again the interlock fittings hold the two halves of the clasp in position.

9. U.S. Pat. No. 4,622,726, was issued to Nakamura on Nov. 18, 1986, for "Releasable Fastening Construction". This device uses a very well known means for retaining a stud on a one piece turn-lock into receivers on a second piece. Although a magnet is used as a secondary holding means, the device is basically a twist-lock fitting tube, with a magnet inside the tube.

Some of the past art devices seen appear too large which detracts from the aesthetic appearance of the final product. The oversized devices appeared in U.S. Pat. Nos. 2,637,887, 2,975,497, 3,129,477, and 3,277,681.

U.S. Pat. Nos. 2,975,497, and 3,129,477, provide devices which do not furnish a linear, or side support means. These devices can inadvertently become disconnected with a transverse or sideways motion which is not as secure as a connecting means providing side bracing. Connecting and disconnecting is somewhat limited in devices disclosed.

When two magnets are used as shown in U.S. Pat. Nos. 3,129,477, 2,615,227, and 4,231,137, increased costs occur in materials and assembly time. If adhesive or soldering is required to mount the magnets additional costs develop. Assembly is simplified if all component parts can be mounted and secured in place with compression connections in the nature of our invention.

A major disadvantage of many clasping devices shown in past art patents is the necessity of the specific alignment required to accomplish connection. This disadvantage was noticed in devices shown in U.S. Pat. Nos. 2,648,884, 4,231,137, 4,622,726, 2,637,887, 2,975,497, 3,277,681, and one embodiment of patent number 2,615,227. Many elderly people with arthritis and those afflicted with some impairment which makes manipulation of small objects difficult, would find these devices difficult if not impossible to master.

Our clasp succeeds in overcoming previously seen disadvantages by providing a cylindrical insert fitting easily into a tubular chamber attached at the connective ends of a necklace. Materials in the chamber wall and special magnetic structure in the tubular chamber pulls in and secures the cylinder end against the magnetic structure. Our clasp holds together well yet is easily unfastened. Special fitting for locking the clasp parts together is not required. A full description of our clasp and its unique characteristics is included in the following specification.

SUMMARY OF THE INVENTION

In practicing our invention, we have provided a cylindrical insert attachable to one end of a necklace which fits easily into a tubular chamber attachable to the other end of the same necklace. When the two ends are brought in close proximity to each other, nonmagnetic conducting materials in the chamber wall allows passage and guidance to special magnetic structures in the tubular chamber which pulls the cylindrical insert into the chamber and secures the cylinder end against the magnetic structure. No fitting or locking of the clasp parts is required, and although our clasp firmly holds the necklace ends together, a straight pull against the ends of the necklace easily releases the parts.

The ferrous and nonferrous composition of materials used in the fabrication of our clasp is important to the unique operational features of the invention. Although we anticipate that other combinations of materials both plastic and metallic would produce similar and satisfactory results, the unique operational features of the present invention set forth in this specification seem best served when the divisional parts of the present invention are fabricated as follows: The cylindrical insert is solid in nature and manufactured of steel or a combination of materials producing a similar attractive effect towards a magnetic field provided by a fixed magnet. An opened tubular insert in the form of a flat ring with a U-shaped narrow crosspiece is positioned in the opened end of the tubular chamber. The tubular insert with crosspiece assumes the appearance of a cookie cutter with a cut-in handle. The tubular insert structure must be brass or of a material with resistance to magnetization similar to brass. The edge of the tubular insert serves the purpose of retaining two half-round steel magnet supports in place and the cross piece presses against the end of a rectangular magnet bar held between the two magnet supports. The described rectangular bar magnet supported top and bottom by the two half-round steel magnet supports fits inside at the back to a closed end in a tubular chamber. The three pieces are retained there by the tubular insert positioned in an open end of the tubular chamber. The half-round steel magnet supports can actually be manufactured of any material or composition of materials capable of a similar interaction to a magnetic field. Steel appeared to best serve the purpose in the present invention. The rectangular magnet may also be manufactured of any material or composition of materials suitable for magnetization. An iron core magnet appeared to best suit the purposes of the present invention. The tubular chamber holding the magnet structure and tubular insert is manufactured of brass for the present invention but may be manufactured of any materials or combination of materials with resistance to magnetization similar to brass. When assembled with the magnet structure and the tubular insert ring installed in the tubular chamber, the cylindrical insert fits slidably through the tubular insert with a flat end against the tubular insert U-shaped crosspiece adjacent the edge of the rectangular magnet and the edges against the ends of the two half-round steel magnet support. The two half-round steel magnet supports pass magnet flux through their molecular structure providing excellent distribution of the magnet force from a small magnet. This enhances the holding power applied to the inserted flat end of the cylindrical insert as the magnetic flux is directed inside the brass chamber along the steel supports to the mass of the cylindrical insert. As both the chamber wall and the tubular insert ring are nonmagnetic conductors, the second half of the clasp, the steel cylindrical insert, is attracted to move towards the chambered magnetic structure when positioned somewhat near the opening into the tubular chamber. This attraction of the cylindrical insert to the tubular chamber assists persons who may have difficulty snapping a mechanical clasp. With the present invention, attaching the opened ends of a necklace together is quite simple. The cylindrical insert and the tubular chamber each have one closed end convexed and affixed with a jewelry attachment ring. Although the two described clasp parts are retained quite securely when together, the clasp parts can be easily separated by pulling on the necklace ends adjacent the attachment rings.

Therefore, a primary object of our invention is to provide a magnetically retained two-piece clasp which is easy to fasten and though firmly retained, easy to separate.

Another object of the invention is to provide a two-piece necklace fastening device in the form of a tube structured of nonferrous materials and an insert structured of ferrous materials with a specially supported magnet in the tube arranged in a manner to attract the insert into the tube from a closely adjacent area.

A further object of the invention is to provide a two-piece magnetically retained tubular clasp type fastener for necklaces and other jewelry which is assembled of simple parts and inexpensive to manufacture.

Other objects and the many advantages of our invention will become understood by reading the specifications and comparing the numbered parts described with similarly numbered parts illustrated in the accompanying drawings.

DESCRIPTION OF THE PREFERRED EMBODIMENT

Figure 1:
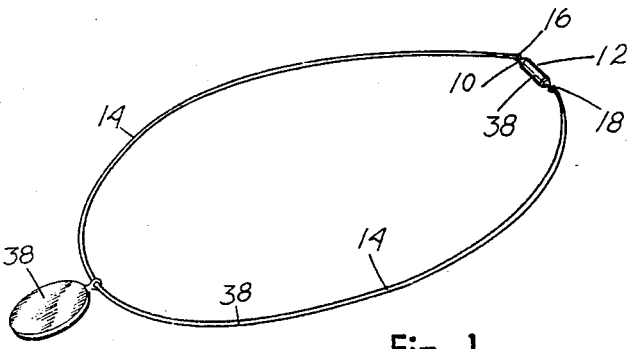
FIG. 1 shows a perspective drawing of a chain necklace with the open ends attached by the tubular magnetic necklace clasp of the present invention.

Referring now to the drawings where the self-aligning magnetic necklace clasp subject of the present invention shows the various members with the parts numerically illustrated. Although it is anticipated composite materials could be effectively substituted for metals, materials used to adequately provide the unique operational features of the clasp are indicated adjacent some of the described parts. Cylindrical insert 10 (solid steel) attaches to one end of necklace 14 by insert jewelry attachment ring 16 centered in convex insert end 34. Tubular chamber 12 (brass) attaches to the other end of necklace 14 by chamber jewelry attachment ring 18 centered in convex chamber end 36. Opened tubular insert 22 (brass) is snap-fitted into the open end of tubular chamber 12 (brass) with U-shaped narrow cross piece 24 (brass) positioned towards the closed end of tubular chamber 12. Also inside tubular chamber 12 immediately adjacent the closed end, convex chamber end 36, is a specially arranged magnetic structure 20 comprising an upper half-round magnet support 26 (solid steel) and a lower half-round magnet support 28 (solid steel) having the rounded halves upwardly and downwardly positioned with bar magnet 30 (a permanent bar magnet) sandwiched between them against flat sides. Bar magnet 30 is somewhat shorter in length than either upper half-round magnet support 26 and lower half-round magnet support 28. The edge of bar magnet 30 contacts the transverse section of U-shaped narrow crosspiece 24 and is retained inside tubular chamber 12 by this contact. The portion of upper half-round magnet support 26 which is longer than bar magnet 30 passes over U-shaped narrow crosspiece 24 and is retained in tubular chamber 12 by the interfaced edge of opened tubular insert 22. The portion of lower half-round magnet support 28 which is longer than bar magnet 30 passes under U-shaped narrow crosspiece 24 and is retained in tubular chamber 12 by the interfaced edge of opened tubular insert 22.

Figure 2:
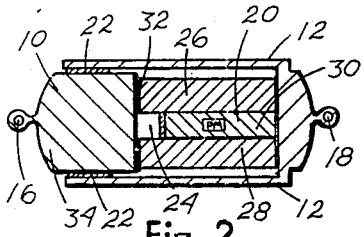
FIG. 2 is a structural side view of the magnetic necklace clasp having the cylindrical insert in the tubular chamber with the flat end adjacent the magnetic structure in position.

FIG. 2 is a side sectional view of tubular chamber 12 (brass) with cylindrical insert 10 (solid steel) inserted through opened tubular insert 22 (brass) into tubular chamber 12 with flat insert end 32 contacting upper half-round magnet support 26 (solid steel) and lower half-round magnet support 28 (solid steel). Magnetic flux from bar magnet 30, somewhat separated from flat insert end 32 by U-shaped narrow crosspiece 24, is directed along both upper half-round magnet support 26 and lower half-round magnet support 28 and asserts a very strong pulling action on flat insert end 32 of cylindrical insert 10.

Figure 4:
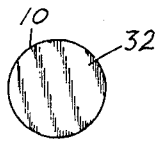
FIG. 4 shows the flat end of the cylindrical insert.
Figure 5:
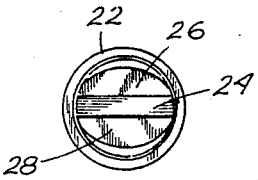
FIG. 5 shows the tubular chamber from the opened end.

In FIG. 4, flat insert end 32 (a steel surface) of cylindrical insert 10 (solid steel) is illustrated in an end view. FIG. 5 shows the open end of tubular chamber 12 (brass) with opened tubular insert 22 (brass) installed. The transversing member of U-shaped narrow crosspiece 24 (brass) is visible horizontally across the center. Upper half-round magnet support 26 (steel) is positioned above the transversing strip and lower half-round magnet support 28 (steel) is below U-shaped narrow crosspiece 24 (brass).

Figure 3:
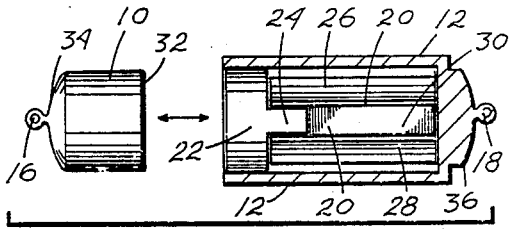
FIG. 3 illustrates the cylindrical insert positioned for attraction into the tubular chamber shown in an opened side structural view illustrating the frontal ring insert and the magnetic structure housed inside adjacent the closed end of the tubular chamber.
Figure 6:
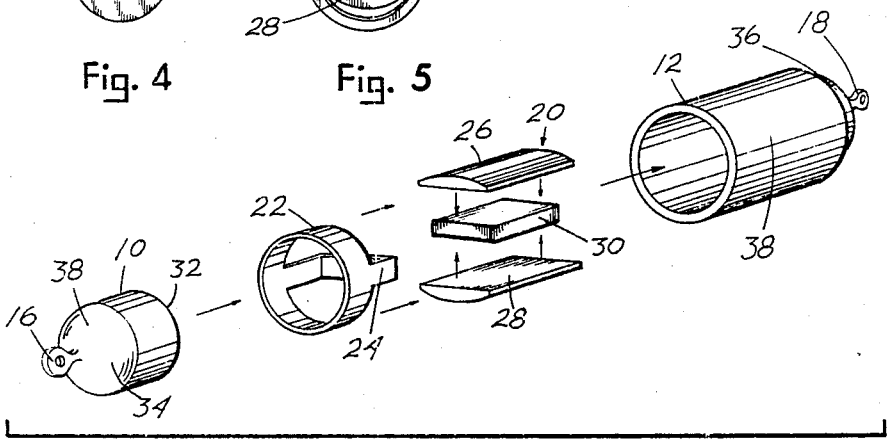
FIG. 6 is an exploded perspective view of the unassembled parts providing the structure of the present invention.

FIG. 3 illustrates the various parts of the clasp assembled in a side view of tubular chamber 12 sectionally opened with cylindrical insert 10 aligned for attachment. In FIG. 6, an exploded view of the (respective parts of the invention) invention parts are shown including cylindrical insert 10, opened tubular insert 22, specially arranged magnetic structure 20, and tubular chamber 12. Arrows indicate the direction of assemblage.

In using the clasp of the present invention, one end of necklace 14 is attached to insert jewelry attachment ring 16 centered in convex insert end 34 of cylindrical insert 10. The other end of necklace 14 is attached to chamber jewelry attachment ring 18 centered in convex chamber end 36 of tubular chamber 12. The two loose ends of necklace 14 can be easily attached together by the clasp of this invention even without seeing them. When cylindrical insert 10 is somewhat aligned and in close proximity to the open end of tubular chamber 12, bar magnet 30 through the upper and lower steel magnet supports asserts sufficient attractive force against cylindrical insert 10 to align and pull the rounded insert structure into the opening of tubular chamber 12. The brass wall of tubular chamber 12 does not retard the inward movement of cylindrical insert 10 towards specially arranged magnetic structure 20 which is a highly efficient magnetic device. Although cylindrical insert 10 is strongly attracted to specially arranged magnetic structure 20, the small separation between flat insert end 32 provided by the side members of the U-shaped narrow crosspiece 24 and there being no retaining mechanics to prevent turning cylindrical insert 10, a twist and pull or a straight pull near the ends of necklace 14 will cause the clasp parts to separate readily. The ends of necklace 14 however, are well secured in the clasp of the present invention and will not separate unless they are pulled apart. The structure of our clasp lends itself well as a fastener for necklaces and other jewelry requiring fastener attachment. A finished plating 38 of gold, silver, and diversified other finishes, makes the clasp of this invention useful in a variety of jewelry applications.

Although we have described our invention with considerable details in the specification, it is to be understood that modifications in the device may be practiced so long as any modifications made do not exceed the intended scope of the appended claims.

What we claim as our invention is:

1. A self-aligning magnetic necklace clasp, comprising:

a cylindrical insert member structured solidly of ferrous materials;

a tubular chamber member structured of non-ferrous materials;

said tubular chamber member being a hollow tubular structure having an open first end and a closed second end a tubular insert;

said tubular insert being a retainer ring having an opened first end a second end partly closed by a centrally disposed U-shaped cross piece, said tubular insert and said U-shaped cross piece structured of non-ferrous materials;

a bar magnet;

at least two bar magnet support members having a ferrous material structure;

said bar magnet support members each having at least one surface transversely configured to conjoin uniformly in width with opposing surfaces of said bar magnet and sized to extend longitudinally beyond an edge of said bar magnet a distance equal to the distance of an opening formed by said U-shaped cross piece in said second end of said tubular insert;

said bar magnet with said support members sized for close tolerance insertion into said tubular chamber member abutting said closed second end;

said tubular insert sized for emplacement inside said tubular chamber member through and adjacent said opened end of said tubular chamber member being retained by wall pressure inside said tubular chamber member with said U-shaped cross piece pressed against said magnet with said extensions of said magnet support members forward of said magnet retained by annular edges abutting an interfaced annular edge of said tubular insert;

said cylindrical insert member sized to be slidably inserted into said tubular chamber member through said tubular insert accessibly protruding therefrom and be removably retained by magnetic flux attraction to an end surface of said cylindrical member in contact with said extended ends of said magnet support members, said ferrous material structure of said magnet support members magnetizing cooperatively with said bar magnet and directing said magnetic flux along a circulatory path through said ferrous material in said cylindrical member, there being air space between said end surface of said cylindrical member and said magnet with said U-shaped cross piece on said tubular insert providing said air space;

means for external attachment at said accessibly protruding end of said solid cylindrical member;

means for external attachment at said closed end of said hollow tubular member.

2. The self-aligning magnetic necklace clasp of claim 1 wherein said means for external attachment at said accessibly protruding end of said solid cylindrical member includes a centrally aligned apertured knob.

3. The self-aligning magnetic necklace clasp of claim 1 wherein said means for external attachment at said closed end of said hollow tubular member includes a centrally aligned apertured knob.

* * * * *